United States Patent [19]

Bader, Jr. et al.

[11] 4,129,255

[45] Dec. 12, 1978

[54] ELECTROMAGNETIC UNIT FUEL INJECTOR

[75] Inventors: Ernest Bader, Jr.; John I. Deckard; Dan B. Kuiper, all of Grand Rapids, Mich.

[73] Assignee: General Motors Corporation, Detroit, Mich.

[21] Appl. No.: 832,085

[22] Filed: Sep. 12, 1977

[51] Int. Cl.[2] ..... F02M 47/02; F02M 55/00

[52] U.S. Cl. ..... 239/96; 123/139 AK; 123/139 E; 239/585

[58] Field of Search ..... 239/88–91, 239/93–96, 124, 533.5, 533.9, 585; 123/32 AE, 139 AE, 139 AK, 139 E

[56] References Cited

U.S. PATENT DOCUMENTS

| | | | |
|---|---|---|---|
| 3,006,556 | 10/1961 | Shade et al. | 239/90 X |
| 3,464,627 | 9/1969 | Huber | 239/96 |
| 3,777,977 | 12/1973 | Regneault et al. | 239/585 X |

*Primary Examiner*—Evon C. Blunk
*Assistant Examiner*—Andres Kashnikow
*Attorney, Agent, or Firm*—Arthur N. Krein

[57] ABSTRACT

An electromagnetic unit fuel injector for use in a diesel engine has a pump including a cam actuated plunger reciprocable in a bushing for intensifying the pressure of fuel delivered to a pressure actuated injection valve controlling flow discharge out through a spray outlet, to a pressure accumulator and, through a throttling orifice passage into one end of a modulation pressure control chamber having a spring biased piston movable therein, the piston engaging one end of the injection valve, this one end of the pressure control chamber downstream of the throttling orifice passage being connected by a conduit, including a solenoid actuated valve controlling flow through a metering orifice to a low pressure fuel drain return line whereby the pressure of fuel in the pressure control chamber acting on the piston is modulated so as to control the seating and unseating of the injection valve.

5 Claims, 7 Drawing Figures

ELECTROMAGNETIC UNIT FUEL INJECTOR

FIELD OF THE INVENTION

This invention relates to unit fuel injectors of the type used for injecting fuel into the cylinder of a diesel engine and, in particular, to an electromagnetic unit fuel injector.

DESCRIPTION OF THE PRIOR ART

Unit fuel injectors of the so-called jerk-type used for the pressure injection of liquid fuel into the cylinder of a diesel engine are well known and include in one unit a cam actuated pump in the form of a plunger and bushing for pressurizing fuel to a relatively high pressure to effect unseating of a pressure actuated injection valve in the fuel delivery injection valve or nozzle assembly of such a unit injector. In the unit fuel injectors now commonly in use, the plunger of the pump is not only reciprocated, but it can also be rotated about its axis by means of a rack in mesh with a gear through which the plunger reciprocates whereby to control the fuel output of the injector by changing the relation of the usual helices provided on the plunger of such a unit relative to the fuel passage ports in the bushing. The plunger helices of such unit injectors have an injection timing function in addition to their metering function. As is well known, the helices of the plunger may be machined, as desired, so as to vary the time of injection at various loads with respect to the engine piston position. With such an arrangement, either or both beginning and ending of injection may be retarded, advanced, or maintained constant with an increase in injector output, depending upon engine requirements. This feature of such unit injectors limits a particular unit injector to one engine family class for which that unit injector has been designed, and, of course, the particular shape of the helices on its plunger controls the operation of that unit injector in a fixed predetermined manner.

SUMMARY OF THE INVENTION

The present invention provides an electromagnetic unit fuel injector that includes a cam actuated plunger and bushing pump assembly for delivery of high pressure fuel to a fuel injection nozzle assembly, a modulation pressure control chamber supplied with fuel from the pump assembly of the unit through a throttling orifice and which is connected by an electromagnetic valve controlled fuel passage, having a metering orifice therein, to a low pressure fuel return line, the modulated fuel pressure provided in the control chamber acting on a spring biased piston which engages one end of the pressure actuated injection valve controlling the discharge of fuel out through the spray tip outlet of the fuel injection nozzle assembly of this unit. Fuel at an intensified high pressure, as supplied by the pump assembly, is stored in the accumulator chamber so that injection of fuel is controlled by operation of the electromagnetic valve whereby to provide quality, pressure-rate control characteristics and pilot injection, as desired.

It is therefore the primary object of this invention to improve a unit fuel injector which is operative to reduce undesirable engine emissions, specifically unburned hydrocarbons, by permitting the electronic advancing, by actuation of an electromagnet valve, to effect the beginning of injection of the pilot and main charges independently with respect to engine revolutions per minute and load, and the nitrogen oxides by controlling the initial heat release by reducing fuel injected in the ignition delay period.

It is another object of the invention to improve a unit fuel injector for use in a diesel engine which is operative so as to effect a reduction of engine noise and mechanical stresses by the control of the injection rate profile of the main injection charge, with the flexible characteristics of pilot injection, if desired.

For a better understanding of the invention, as well as other objects and further features, reference is had to the following detailed description of the invention to be read in connection with the accompanying drawings.

DESCRIPTION OF THE PREFERRED EMBODIMENT

Figure 1:
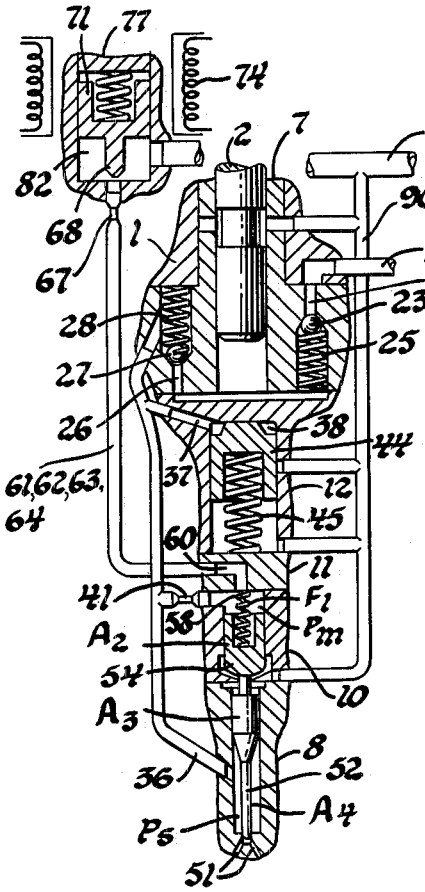
FIG. 1 is a schematic illustration of the primary operating elements of an electromagnetic unit fuel injector in accordance with the invention.

Referring now to the drawings and, in particular, to FIGS. 2 through 6, inclusive, there is shown an electromagnetic unit fuel injector, constructed in accordance with the invention, that is, in effect, a unit fuel injector-pump assembly with a solenoid valve incorporated therein to control fuel discharged from the injector portion of this assembly. As shown, the electromagnetic unit fuel injector includes a hollow body or housing 1 having a pump plunger 2 and a plunger actuated follower 3 reciprocally mounted therein. The follower 3 extends out one end of the housing 1 whereby it and the plunger connected thereto are adapted to be reciprocated by an engine driven cam or rocker, not shown, and by a plunger return spring 4 in a conventional manner, a stop pin 5 extending through the housing to limit upward travel of the follower 3.

Forming an extension of and threaded to the lower end of the housing 1 is a nut 6 within which is supported a bushing-cage 7 with a bore **7*a* therethrough to provide the pump cylinder for the plunger 2, this bushing-cage hereinafter being referred to as the bushing 7. The bushing 7 is of external stepped configuration whereby its upper end is supported within the housing 1**.

Nut 6 has an opening **6*a* at its lower end through which extends the lower end of the combined injection spray tip and valve body 8**, hereinafter referred to as the valve body, of a fuel injector nozzle assembly. As shown, the valve body 8 is enlarged at its upper end to provide a shoulder 8*a* which seats on an internal shoulder 6*b* provided by the through counterbore in nut 6. Between the valve body 8 and the bushing 7 there is positioned, in sequence starting from the valve body, a modulation pressure control cage 10, a cross-over cage 11 and an accumulator cage 12, these elements being formed, in the construction illustrated, as separate elements for ease of manufacturing and assembly. The threaded connection 14 of the nut 6 to housing 1 holds the valve body 8, modulation pressure control cage 10, cross-over cage 11 and accumulator cage 12 clamped and stacked end-to-end between the shoulder 6*b* of nut 6 and the bottom face or surface of bushing 7. All of these above described elements have lapped mating surfaces whereby they are held in pressure sealed relation to each other and, in addition, dowels, not shown, are used to maintain the desired, aligned, position of these elements relative to each other in a manner well known in the art.

Figure 4:
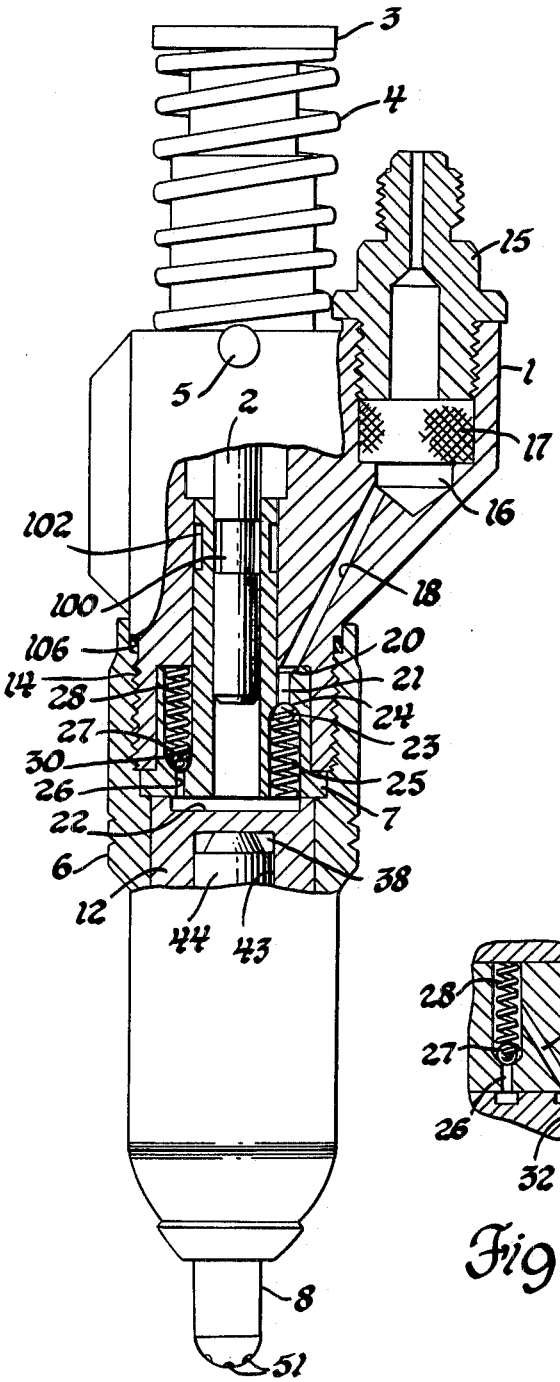
FIG. 4 is a sectional view taken along line 4—4 of FIG. 3.

Fuel, as from a fuel tank via a supply pump and conduit, not shown, is supplied to the lower open end of the bushing 7 by a fuel supply passage means which includes an apertured inlet or supply fitting 15, as shown in FIG. 4, fixed to the housing 1, that leads to a filter chamber 16 provided within the housing containing a filter 17. The outlet from the filter chamber 16 communicates via a passage 18 in housing 1 with a recessed channel 20 in the upper end of bushing 7 and, then via a stepped passage 21 through the bushing to a recessed cavity 22 provided in the upper end of the accumulator cage 12, this cavity 22 being in flow communication with the lower open end of the bushing 7. Flow through the inlet passage means is controlled by a one-way check valve shown in the form of a ball 23 positioned in the enlarged portion of the passage 21 and which is biased into seating engagement against a valve seat 24 within this passage by a compression spring 25 so that, during a suction stroke of plunger 2, fuel can be drawn into the pump cylinder through the open end of the bushing.

Figure 5:
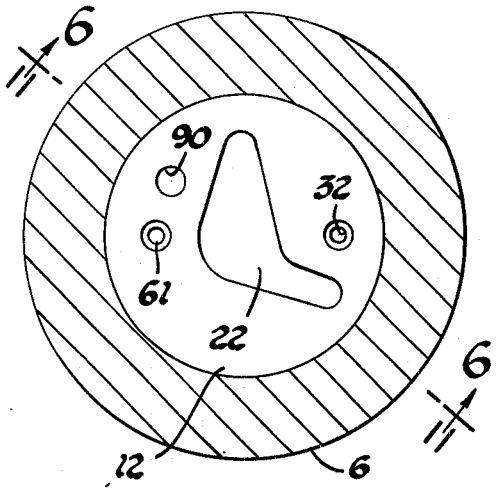
FIG. 5 is a sectional view taken along line 5—5 of FIG. 2.
Figure 7:
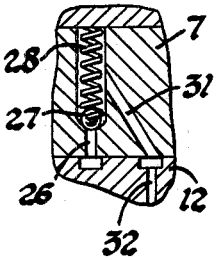

During a pump stroke of plunger 2, fuel is discharged from the open end of the bushing at an intensified pressure into the recessed cavity 22 which is of a configuration, as shown in FIG. 5, so as to also be in communication with one end of an intensified fuel or discharge passage means that includes a passage 26, provided in the bushing 7, with flow therethrough controlled by a one-way check valve that includes a ball 27 and a spring 28 which normally biases the ball 27 into seating engagement with its cooperating valve seat 30. The discharge passage means further includes, as shown in FIG. 7, a downwardly directed passage 31 in bushing 7 which, at one end intersects the passage 26 downstream of ball 27 and at its other end opens into the enlarged end of a stepped passage 32 provided in the accumulator cage 12, this latter passage 32 being in communication with a stepped through passage 33 in cross-over cage 11, a passage 34, in modulation pressure control cage 10, opening into an annular groove 35 at the lower end of the control cage 10 which, in turn, is in communication with the drilled fuel passages 36 in valve body 8, whereby fuel at an intensified fuel pressure can be supplied to the fuel injector nozzle assembly for discharge into the combustion cylinder of an engine, not shown.

The intensified fuel or discharge passage means further includes a branch passage 37 extending from stepped passage 32 for supplying fuel to an accumulator chamber 38 in the accumulator cage 12 and a branch passage 40, having a throttling orifice 41 therein that extends from stepped through passage 33 in cross-over cage 11 for supplying fuel to a modulation pressure control chamber 42 provided in the modulation pressure control cage 10.

With this arrangement, during a pump stroke of plunger 2, part of the fuel at an intensified pressure discharged therefrom is delivered via the discharge passage means to the accumulator chamber 38 in the accumulator cage 12. As shown, this cage is of inverted cup shape with a bored opening extending from one end thereof to provide a cylindrical inner wall 43 to slidably receive an accumulator piston 44, the piston 44 forming with the annular wall 43 the accumulator chamber 38 adjacent to the closed, upper end of the accumulator cage 12. A rate spring 45 positioned within the recessed opening of the accumulator cage 12 normally biases the accumulator piston 44 in an axial direction whereby to reduce the volume of fluid in the accumulator chamber 38.

Figure 2:
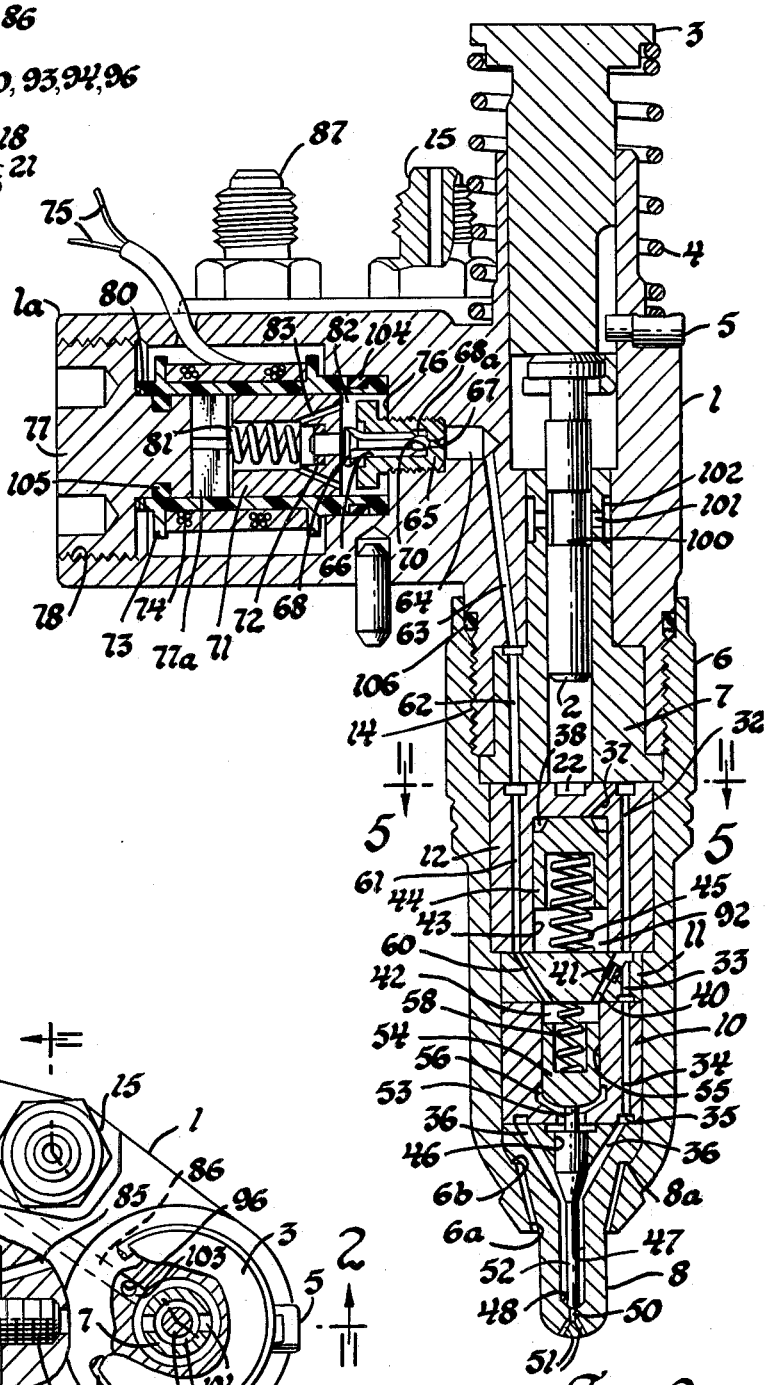
FIG. 2 is a longitudinal, sectional view of an electromagnetic unit fuel injector in accordance with the invention, this view being taken along line 2—2 of FIG. 3 with the elements of the injector being shown with the plunger of the pump thereof positioned prior to the start of a pump stroke and the electromagnetic means thereof de-energized.

Fuel at an intensified pressure is also supplied to the valve body 8 of an injection nozzle assembly which may be of any suitable type known in the art. In the construction illustrated, the valve body 8, as seen in FIG. 2, is provided with a central stepped bore therethrough which provides in the construction shown, in sequence, an internal annular stepped wall 46 extending a predetermined distance from the upper end of the valve body, an internal annular wall 47 of reduced diameter relative to the wall 46, this latter wall 47 terminating at an annular valve seat 48 encircling a spray tip passage 50 in the lower end of the valve body, the passage 50 connecting to one or more spray tip orifices 51 which open to an engine combustion chamber, not shown.

Flow through the spray tip passage 50, and thus through orifices 51, is controlled by a needle type, injection valve 52 which has its large diameter stem portion slidably journalled in the valve guide provided by a portion of wall 46, the lower stem portion of this valve forming with the wall 47 an annular fuel chamber that is supplied with fuel at an intensified pressure via the drilled passages 36. The upper end of the injection valve 52 is provided with a reduced diameter extension 53 which loosely projects through an apertured opening in the lower end of the modulation pressure control cage 10 to engage the lower, closed end of a modulator piston 54 reciprocally journalled therein.

As shown, the modulation pressure control cage 10 has a stepped bore therethrough to provide an internal, upper cylinder wall 55 that slidably receives the modulator piston 54 forming therewith the modulation pressure control chamber 42, an intermediate chamber 56 and a lower apertured opening 57 through which the extension 53 of injection valve 52 projects. A spring 58 is positioned partly in the upper, open end of the modulator piston 54 in abutment thereagainst, the opposite end of the spring abutting against the lower face of the cross-over cage 11 whereby to normally bias the piston 54 in a direction, downward with reference to the drawings, to effect seating of the injection valve 52 against its valve seat 48.

As described, the modulator piston 54 and cylinder wall 55 of control cage 10 define the modulation pressure control chamber 42 at one end of the control cage 10, the upper end with reference to the drawings. This control chamber 42 is connected by the branch passage 40, having the throttling orifice 41 of predetermined size therein, provided in the cross-over cage 11, with the discharge passage means previously described. With this arrangement, during a pumping stroke of the plunger 2, the fuel at an intensified pressure discharged from the open end of bushing 7 flows at a controlled rate into the modulation pressure control chamber 42 to act against the modulator piston 54 whereby to apply a force, in addition to that of the spring 58, whereby to control seating of the injection valve 52, as described in detail hereinafter.

Modulation of the fuel pressure in the modulation pressure control chamber 42 is obtained by connection of this chamber via a modulated pressure passage means to a fuel drain passage means for fuel at reduced, low pressure. The modulated pressure passage means includes an outlet passage 60 from the control chamber 42, that is suitably provided, for example, in cross-over cage 11, the passage 60 being connected in flow registration with a passage 61 provided in accumulator cage 12, a passage 62 in bushing 7 and a passage 63 in housing 1 that opens into one end of a flow compartment or chamber 64 formed in the housing 1 by a counterbored stepped opening extending from one end of a side extension 1*a* of this housing.

Flow from the flow compartment or chamber 64 to the low pressure fuel return or drain passage means is controlled by a normally closed, solenoid actuated valve controlling flow through a metering orifice 67 provided in the modulated pressure passage means. In the construction illustrated, a valve cage 65, threadingly secured in the side extension 1*a* of housing 1, is provided with a stepped bored passage 66 therethrough having the metering orifice 67, of predetermined diameter, therein opening into the chamber 64, the enlarged internal diameter portion of passage 66 slidably receiving the fluted end of an electromagnetic or solenoid actuated valve 68 which has a tip 68*a* adapted to engage the valve seat 70 that encircles the portion of passage 66 containing metering orifice 67. The opposite end of the valve 68 extends through the open end of a solenoid armature 71 and is fixed against axial movement relative thereto by an annular retainer 72, that, for example, is press fitted onto the stem end of the valve 68 opposite tip 68*a*.

The armature 71 is slidably received in a tubular bobbin 73 which has a magnetic wire solenoid coil winding 74 wrapped around it that is connected by a pair of electrical leads 75 to a suitable source of electrical power via a conventional fuel injection electronic control circuit, not shown, whereby the solenoid can be energized as a function of operating conditions of the engine in a well known manner. Bobbin 73 is positioned in the bore cavity in the side extension 1*a* of the housing 1 between an inner shoulder 76 of the housing and a solenoid core or pole 77 threaded at 78 to the internally threaded portion bore cavity in side extension 1*a*. The reduced diameter portion of the core or pole 77 with its cross-slotted free end 77*a* extends a predetermined axial distance into the bobbin 73 to serve as a stop for limiting axial movement of the armature 71 in one direction, to the left as seen in FIG. 2, when the solenoid is energized, suitable shims 80 being positioned, as necessary, between the bobbin 73 and pole 77. As shown, the armature 71 and therefore the valve 68 are normally biased axially in the opposite direction, to the right as seen in FIG. 2, by a compression spring 81 positioned in the recessed, open end of the armature 71.

The interior of the bobbin 73 between the free end of the valve cage 65 and the one end of the armature 71 to which the valve 68 is attached forms with these elements a fuel return chamber 82 that is in communication via axial extending passages 82 in armature 71 with the opposite open end of this armature.

Figure 3:
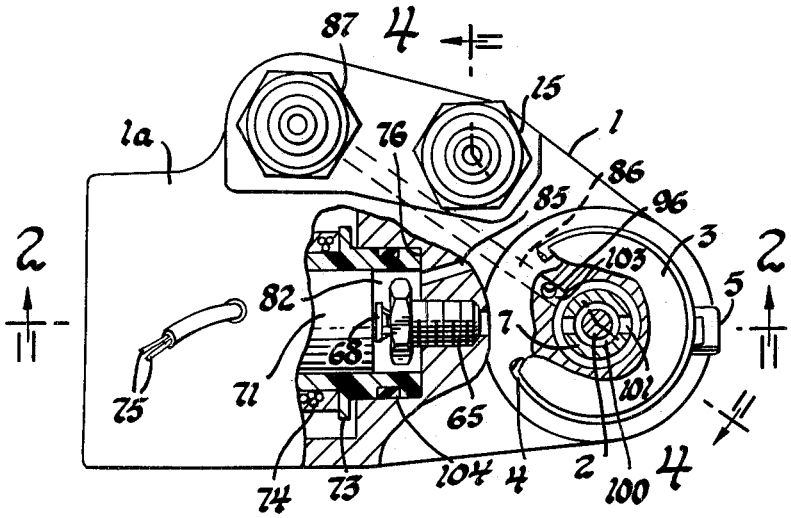
FIG. 3 is a top view of the subject electromagnetic unit fuel injector with portions broken away to show the structural relationship of various elements of the injector.

The fuel return chamber 82 forms part of a fuel drain passage means, for the return of fuel to the fuel tank that is used to supply fuel to the unit injector, this drain passage means further including a passage 85 opening into chamber 82 through shoulder 76, as seen in FIG. 3, that connects via a return passage 86 in housing 1 to an apertured fuel outlet or drain fitting 87 fixed to housing 1 and which is adapted to be connected by a fuel drain conduit, not shown, to the fuel tank, not shown.

Figure 6:
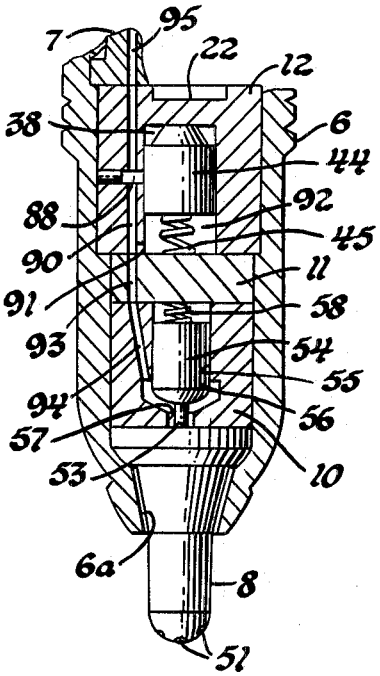
FIG. 6 is a partial sectional view taken along line 6—6 of FIG. 5; and, FIG. 7 is a partial sectional view of the bushing of the injector rotated with respect to its position shown in FIG. 4 to further illustrate the discharge flow path of fuel.

The accumulator piston 44, as slidably received within the accumulator cage 12, is also operative to act as a pressure release valve since, upon downward movement of this accumulator piston, from its position shown in FIGS. 1, 2 and 6, it will uncover a side relief port 88 that is located a predetermined axial distance from the upper end of the accumulator chamber 38 for this purpose. This relief port 88 also connects to the fuel drain passage means which further includes a drain passage 90 extending axially through the accumulator cage 12, as seen in FIG. 6. At one end, its lower end as seen in FIG. 6, the drain passage 90 is also connected by a side port 91 to the chamber 92 on the opposite side of the accumulator piston 44 from accumulator chamber 38, and, also via a drain passage 93 in cross-over cage 11 to a drain passage 94 provided in the modulation pressure control cage 10 that is in communication with the intermediate chamber 56 therein which, in turn, is in communication via the apertured opening 57 to the upper end of the enlarged stem portion of valve 52, as best seen in FIG. 2, so as to permit drainage of any fuel leaking along the outer peripheral surface of the journalled stem portion of the injector valve.

At its opposite end, the drain passage 90 is in flow communication with a drain passage 95 extending through the bushing 7 to interconnect with a drain passage 96 in the housing 1 which in turn communicates with the previously described passage 86 extending to the apertured drain fitting 87. Any bypass leakage from the plunger 2 accumulates in an undercut annulus 100 formed intermediate the ends of the plunger 2 and flows through radial passages 101 to a recessed annulus 102 on the outer peripheral surface of the bushing 7, the annulus 102 being suitably ported through a passage 103 to the drain passage 96, as shown in FIG. 3.

Suitable seals 104 and 105 are provided for sealing engagement between the bobbin 73 and housing 1 and bobbin 73 and pole 77, respectively, and a seal 106 is used for sealing engagement between housing 1 and nut 6.

Functional Description

Referring now to the drawings and, in particular, to FIG. 1 which schematically illustrates the primary operating elements of the subject unit injector, fuel at a suitable predetermined pressure is supplied to the subject unit injector via the supply fitting 15 through the inlet passage means including filter 17 into the pressure intensification pump chamber of the unit via the open end of the bushing 7 wherein the fuel pressure is intensified to a substantially higher supply pressure $P_s$, for example, 15,000 psi, during the downward stroke of the follower 3 moving the plunger 2 on its pump stroke within the cylinder of bushing 7. The high fuel pressure at a pressure $P_s$, as thus developed, flows out through the discharge passage means, as controlled by ball check valve 27, to the circumferential fuel chamber surrounding the injection valve 52 in the valve housing 8. In the cross-over cage 11, the high fuel pressure passes into the modulation pressure control chamber 42 through the throttling orifice 41. In a static condition, the modulation pressure level in the modulation pressure control chamber 42 is the same as the intensified supply pressure retained in the modulation pressure passage means between the solenoid actuated valve 68 and the modulation pressure control chamber 42. The quantitative intensified supply pressure is also stored by the displacement of the accumulator piston 44 against the biasing action of spring 45 by the supply of fuel under intensified pressure flowing through the branch passage 37 into the accumulator chamber 38.

An electrical (current) pulse of finite characteristic and duration (timed relative to the top-dead-center of engine piston position with respect to the camshaft and injector rocker arm linkage, not shown) applied through the leads 75 to the coil winding 74 produces an electromagnetic field attracting the armature 71 to the pole 77 thereby raising the solenoid actuated valve 68 from its valve seat 70 to permit flow of fuel through the metering orifice 67 from the modulation pressure control chamber 42 to chamber 82. The rate of pressure drop in the modulated pressure passage means and in the modulator pressure control chamber 42 is determined by the predetermined diameter ratio of the metering orifice 67 to the throttling orifice 41 and, when the pressure decay rate in the modulation pressure control chamber 42 reaches the spray tip injection valve 52 opening pressure level $P_o$, this injection valve "pops" from its valve seat 48 to permit the injection of fuel out through the spray tip orifices 51. The rate of modulation pressure decay determines and controls the velocity of the injection valve lift and hence the pressure-rate injection profile of the unit injector.

The fuel passing through the solenoid valve controlled modulated pressure passage means into the fuel return chamber 82 drops to the low pressure of fuel present in the fuel drain passage means, since the drain fitting 87 is directly connected by a fuel return or drain conduit, not shown, to a fuel tank, also not shown, in which fuel is stored at a pressure corresponding substantially to atmospheric pressure. Also, drainage from the chamber 92 below the accumulator piston 44 and from the chamber 56 below the modulator piston 54 flows into the fuel return drain passage means to drain back to the fuel tank. As previously described, any fuel bypass leakage from around the plunger 2 accumulates in the annulus 100 and flows through the passages 101 to the annulus 102 which is ported to the fuel return drain passage means through the passage 103.

Termination of the electrical pulse to the coil 74 collapses the electromagnetic force between the pole 77 and armature 71. As this occurs, the force of the rate spring 81 provides a fast response closure of the valve 68 causing the modulation pressure in chamber 42 to then rise to a spray tip injection valve 52 closure pressure $P_c$ which pressure is higher than the opening injection pressure $P_o$, it being noted that a conventional pressure actuated injector nozzle injects with a high opening pressure with injection terminating at a lower pressure.

The closure pressure $P_c$ and the opening pressure $P_o$ are defined by the following formulas:

$$P_c = \frac{P_s(A_3) - F_1}{A_2}$$

$$P_o = \frac{P_s(A_3 - A_4) - F_1}{A_2}$$

wherein, as seen in FIG. 1:

$P_m$ = modulation pressure in modulation pressure control chamber 42
= $P_o$ valve opening pressure
= $P_c$ valve closing pressure
$P_s$ = supply intensified pressure
$A_2$ = effective area of modulator piston 54
$A_3$ = effective area of enlarged diameter stem portion of injection valve 52
$A_4$ = effective area of lower reduced diameter stem portion of injection valve 52
$F_1$ = force rate of spring 58 acting against modulator piston 54

The response control of the subject electromagnetic unit fuel injector is such as to permit pilot injection operation with minimum durations of 0.2 millisecond, electronically timed with respect to the engine camshaft position (T.D.C.) on an engine system R.P.M./load schedule.

It will be apparent to those skilled in the art that numerous changes and modifications can be made to the preferred embodiment of the subject electromagnetic unit fuel injector illustrated and described, without departing from the teaching of this invention. For example, the metering orifice 67, instead of being provided in the valve cage 65, as illustrated, can readily be positioned anywhere in the modulated pressure passage means between the modulation pressure control chamber 42 and the solenoid actuated valve 68 and, in a similar manner, the throttle orifice 41 and the branch passage 40 can be positioned to intersect and receive fuel from the intensified fuel discharge passage means at any desired location upstream of the modulation pressure chamber 42 for supplying fuel thereto.

What is claimed is:

1. An electromagnetic unit fuel injector-pump assembly including a housing means having a fuel inlet and a fuel drain outlet at one end thereof and including a valve body terminating in a spray outlet at its other end, a pump cylinder in said housing means, a plunger reciprocable in said cylinder, said cylinder being open at one end for the ingress and egress of fuel during reciprocation of said plunger, a valve controlled inlet passage means in said housing means connecting said inlet to said open end of said cylinder, discharge passage means connected at one end to said open end of said cylinder, a one-way valve in said discharge passage means adjacent said one end thereof, an injection fuel delivery passage connected at one end to said valve controlled discharge passage means and terminating at its other end at said spray outlet, an injection valve in said delivery passage having one end thereof in position to close said spray outlet, a pressure accumulator chamber in said housing means, a first piston reciprocal in said pressure accumulator chamber, conduit means connecting said discharge passage means to one end of said pressure accumulator chamber, drain passage means in said housing means connected at one end to said drain outlet, drain conduit means connecting the opposite end of said pressure accumulator chamber to said drain passage means, spring means in said pressure accumulator chamber normally biasing said first piston toward said end of said pressure accumulator chamber in communication with said outlet passage means, a pressure chamber in said housing means, said injection valve having its other end thereof projecting into said pressure chamber, a second piston reciprocable in said pressure chamber, a rate spring means in said pressure chamber normally biasing said second piston into engagement with said injection valve to move said injection valve in a direction to normally close said spray outlet, a throttling orifice passage connecting said discharge passage means to said pressure chamber on the side thereof containing said rate spring means, said drain passage means being in communication with the opposite end of said pressure chamber and, conduit means including a solenoid actuated valve controlled metering orifice connected to said pressure chamber downstream of said throttling orifice and at its other end in fluid communication with said drain outlet.

2. An electromagnetic unit fuel injector-pump assembly including a housing means having a fuel inlet and a fuel drain outlet at one end thereof and including a valve body, terminating in a spray outlet at its other end, a pump cylinder in said housing means, a plunger reciprocable in said cylinder, said cylinder having an open end for the ingress and egress of fuel during reciprocation of said plunger, a valve controlled inlet passage means in said housing means connecting said inlet to said cylinder open end, discharge passage means having a check valve therein connected at one end to said cylinder open end with said check valve next adjacent thereto, said discharge passage means including an injection fuel delivery passage in said valve body terminating at said spray outlet, an injection valve movable in said valve body with one end thereof movable between a closed position and an open position relative to said spray outlet, a pressure accumulator means in said housing means having one end thereof in communication with said discharge passage means, drain passage means in said housing means connected at one end to said drain outlet and including drain conduit means connected to the opposite end of said pressure accumulator means, a pressure chamber in said housing means, said injection valve having its other end thereof projecting into said pressure chamber, a piston reciprocable in said pressure chamber, a rate spring means in said pressure chamber normally biasing said piston into engagement with said injection valve to move said injection valve to said closed position, a throttling orifice passage connecting said discharge passage means to said pressure chamber on the side thereof containing said rate spring means, said drain passage means being in communication with the opposite end of said pressure chamber, and solenoid valve controlled passage means including a metering orifice operatively connected at one end to said pressure chamber downstream of said throttling orifice and at its other end connected in fluid communication with said drain outlet.

3. An electromagnetic unit fuel injector including a housing means having a fuel inlet and a fuel drain outlet, a pump cylinder in said housing means, a cam actuated plunger reciprocable in said cylinder, said cylinder being open at one end for discharge of fuel displaceable by said plunger during a pump stroke and for fuel intake during a suction stroke of said plunger, a valve controlled fuel inlet passage means connecting said fuel inlet to said cylinder open end, a fuel injector including a valve body carried by said housing means, said valve body having a spray outlet at one end thereof for the discharge of fuel, an injection valve movable in said valve body between an open position and a closed position relative to said spray outlet, a discharge passage means having a check valve therein connecting said cylinder open end to said spray outlet, a pressure chamber means in said housing means, a bore in said valve body slidably guiding said injection valve and opening into said pressure chamber means, said injection valve having a piston portion exposed to fuel pressure in said discharge passage means adjacent said spray outlet for effecting movement of said injection valve to said open position, a spring biased modulator piston movably positioned in said pressure chamber means for abutment against one end of said injection valve to bias said injection valve to said closed position, said discharge passage means including a throttling orifice passage connected to the end of said pressure chamber means opposite said bore, a drain passage means connected at one end to said fuel drain outlet, modulated pressure passage means connected at one end to said one end of said pressure chamber means downstream of said throttling orifice passage and connected at its opposite end to an opposite end of said drain passage means, said modulated pressure passage means including a solenoid valve controlling flow through a metering orifice whereby to control the pressure in said pressure chamber means acting on said modulator piston whereby to control the movement of said injection valve between said open position and said closed position, and pressure accumulator means in said housing means in communication with said discharge passage means that is operative to store fuel under pressure during a pump stroke of said plunger.

4. An electromagnetic unit fuel injector including a housing means having a fuel inlet and a fuel drain outlet at one end thereof, a fuel injector including a valve body carried by said housing means at its opposite end, said valve body having a spray outlet at one end exterior of said housing means, an injection valve movable in said valve body to open and close said spray outlet, a pump cylinder in said housing means, a cam actuated plunger reciprocable in said cylinder, said cylinder having an open end for the ingress and egress of fuel during a suction stroke and a pumping stroke, respectively, of said plunger, a valve controlled inlet passage means in said housing means connecting said inlet to said cylinder open end, discharge passage means including a check valve connected at one end to said cylinder open end and at its other end terminating at said spray outlet, said check valve being positioned next adjacent to said cylinder open end, a pressure accumulator chamber in said housing means connected at one end to said discharge passage means downstream of said check valve, an accumulator piston slidably journaled in said pressure chamber, a spring means positioned in said chamber to abut against said accumulator piston whereby fuel discharged during a pump stroke of said plunger can be stored under pressure within said pressure accumulator chamber, a pressure chamber in said housing means, a modulator piston slidably journaled in said pressure chamber, said injection valve having its end opposite said spray outlet operatively connected to said modulator piston, a rate spring means in said pressure chamber positioned to abut against said modulator piston for biasing said injection valve to the closed position, said discharge passage means further including a throttling orifice passage connected to said pressure chamber on the side thereof containing said rate spring means, a drain passage means connected at one end to said fuel drain outlet, a modulated pressure passage means including a solenoid actuated valve controlled metering orifice connected at one end to said pressure chamber at the end thereof connected to said throttling orifice, the opposite end of said modulated pressure passage means being connected to an opposite end of said drain passage means, said drain passage means also being operatively connected to said pressure chamber on the side opposite thereof from said throttling orifice passage.

5. An electromagnetic unit fuel injector according to claim 4 wherein said drain passage means includes drain conduit means connected to the opposite end of said pressure accumulator chamber from said discharge passage means and a side port passage opening into said pressure accumulator chamber at a location intermediate its ends to be uncovered by said accumulator piston upon predetermined axial movement of said accumulator piston within said pressure accumulator chamber for venting of any excess fuel under pressure therefrom.

* * * * *